US010507344B2

(12) United States Patent
Baldino et al.

(10) Patent No.: US 10,507,344 B2
(45) Date of Patent: Dec. 17, 2019

(54) ADVANCED MISTING DELIVERY SYSTEM, METHODS, AND MATERIALS

(71) Applicant: Mark Steven Baldino, Lorton, VA (US)

(72) Inventors: Mark Steven Baldino, Lorton, VA (US); Alain Briancon, Germantown, MD (US)

(73) Assignee: Mark Steven Baldino, Lorton, VA (US)

( * ) Notice: Subject to any disclaimer, the term of this patent is extended or adjusted under 35 U.S.C. 154(b) by 211 days.

(21) Appl. No.: 15/637,564

(22) Filed: Jun. 29, 2017

(65) Prior Publication Data

US 2018/0099170 A1 Apr. 12, 2018

Related U.S. Application Data

(60) Provisional application No. 62/496,213, filed on Oct. 11, 2016, provisional application No. 62/492,756, filed on May 1, 2017.

(51) Int. Cl.

| | |
|---|---|
| ***A62C 35/13*** | (2006.01) |
| ***A62C 35/15*** | (2006.01) |
| ***A62C 37/10*** | (2006.01) |
| ***A62C 37/40*** | (2006.01) |

(Continued)

(52) U.S. Cl.

CPC ..... *A62C 35/13* (2013.01); *A62C 35/15* (2013.01); *A62C 37/10* (2013.01); *A62C 37/40* (2013.01); *B05B 1/02* (2013.01); *B05B 3/08* (2013.01)

(58) Field of Classification Search

CPC ..... A62C 3/002; A62C 3/006; A62C 3/008; A62C 25/00; A62C 35/026; A62C 35/13; A62C 35/15; A62C 37/10; A62C 37/11; A62C 37/40; B05B 1/02; B05B 3/08

See application file for complete search history.

(56) References Cited

U.S. PATENT DOCUMENTS

| | | | |
|---|---|---|---|
| 6,104,301 | A | 8/2000 | Golden |
| 6,360,825 | B1 | 3/2002 | Padgett |
| 7,898,427 | B1 | 3/2011 | Kim |

(Continued)

OTHER PUBLICATIONS

International Search Report and Written Opinion of related application PCT/US2017/056007 filed Oct. 11, 2017, dated Jan. 2, 2018. 15 pages.

*Primary Examiner* — Darren W Gorman
(74) *Attorney, Agent, or Firm* — BakerHostetler

(57) ABSTRACT

An embodiment of the present invention includes an advanced adjustable density misting delivery system (AMDS) for detecting and neutralizing a fire. The AMDS includes a bladder containing a fire suppressant material, a pump operatively connected to the bladder via a tube, and a nozzle operatively connected to the pump and the bladder via the tube. The AMDS also includes a controller electrically connected to the pump and a sensor in communication with the controller, where the sensor is configured to detect a parameter that indicates the presence of the fire. The controller is configured to transition the pump from a deactivated state to an activated state when the sensor detects the parameter, such that in the deactivated state the pump does not operate, and in the activated state the pump causes the fire suppressant to flow from the bladder, through the tube, and out the nozzle.

18 Claims, 5 Drawing Sheets

(51) Int. Cl.
*B05B 1/02* (2006.01)
*B05B 3/08* (2006.01)

(56) References Cited

U.S. PATENT DOCUMENTS

| | | | | |
|---|---|---|---|---|
| 8,672,045 | B2 | 3/2014 | Whitney | |
| 2004/0145466 | A1* | 7/2004 | Anthony | G08B 17/00 340/522 |
| 2005/0265423 | A1* | 12/2005 | Mahowald | H05B 6/687 374/121 |
| 2006/0131035 | A1 | 6/2006 | French | |
| 2007/0044979 | A1 | 3/2007 | Popp et al. | |
| 2008/0271903 | A1* | 11/2008 | Lindstrom | A62C 35/02 169/61 |
| 2010/0116513 | A1 | 5/2010 | Phillips | |

* cited by examiner

ADVANCED MISTING DELIVERY SYSTEM, METHODS, AND MATERIALS

CROSS REFERENCE TO RELATED APPLICATIONS

This application claims the priority benefit of U.S. Provisional Application No. 62/496,213, which was filed Oct. 11, 2016, as well as U.S. Provisional Application No. 62/492,756, which was filed May 1, 2017, each of which are incorporated herein by reference in their entireties.

TECHNICAL FIELD

The present invention relates to fire suppressant delivery systems. More particularly, this invention relates to misting systems for the delivery of a fire suppressant material to a fire.

BACKGROUND

Fires, especially those caused by flammable liquids, cause extensive amounts of property damage and human harm every year. In particular, a large proportion of fires start on electric or gas range stovetops. Currently, many systems exist for extinguishing fires, including handheld fire extinguishers and sprinkler systems. However, handheld fire extinguishers require manual actuation, while sprinkler systems cover a wide area, and can often destroy property during operation that extends well beyond the area affected by fire, and may not be suited for electrical or grease fires. Further, neither of these systems provide any methodology for helping determine the root cause of the fire after it has been extinguished. As a result, there is a need for a localized, automatic fire extinguishing system suited for stovetops, as well as a fire extinguishing system that includes forensic and auditing functionalities.

SUMMARY

An embodiment of the present invention includes an advanced adjustable density misting delivery system (AMDS) for detecting and neutralizing a fire. The AMDS includes a bladder containing a fire suppressant material, a pump operatively connected to the bladder via a tube, and a nozzle operatively connected to the pump and the bladder via the tube. The AMDS also includes a controller electrically connected to the pump and a sensor in communication with the controller, where the sensor is configured to detect a parameter that indicates the presence of the fire. The AMDS further includes a power supply configured to provide power to the controller and the pump. The controller is configured to transition the pump from a deactivated state to an activated state when the sensor detects the parameter, such that in the deactivated state the pump does not operate, and in the activated state the pump causes the fire suppressant to flow from the bladder, through the tube, and out the nozzle.

Another embodiment of the present invention includes an advanced adjustable density misting delivery system (AMDS) for detecting and neutralizing a fire. The AMDS includes a bladder containing a fire suppressant material and a pump operatively connected to the bladder via a tube. The AMDS also includes a nozzle operatively connected to the pump and the bladder via the tube, such that the pump is configured to cause the fire suppressant to flow from the bladder, through the tube, and out the nozzle. Additionally, the AMDS includes a controller electrically connected to the pump, where the controller includes a first sensor configured to detect a first parameter related to the operation of the AMDS. Further, the AMDS includes a second sensor in communication with the controller, the second sensor being configured to detect a second parameter that indicates the presence of the fire, and a power supply configured to provide power to the controller and the pump.

A further embodiment of the present invention includes a method for dispensing fire suppressant from an adjustable density misting delivery system (AMDS) that includes a hollow housing. The method includes detecting, via a sensor, a parameter that indicates the presence of a fire and activating, via a controller in communication with the sensor, a pump from a deactivated state to an activated state. The method also includes flowing the fire suppressant from a bladder, through tubes, and out a nozzle using force provided by the pump when the pump is in the activated state, wherein the bladder and tubes are disposed within the housing of the AMDS, and the nozzle is connected within the housing of the AMDS.

BRIEF DESCRIPTION OF THE DRAWINGS

The foregoing summary, as well as the following detailed description, will be better understood when read in conjunction with the appended drawings. The drawings show illustrative embodiments of the invention. It should be understood, however, that the application is not limited to the precise arrangements and instrumentalities shown.

DETAILED DESCRIPTION OF ILLUSTRATIVE EMBODIMENTS

While the invention is described herein using a limited number of embodiments, these specific embodiments are not intended to limit the scope of the invention as otherwise described and claimed herein. The precise arrangement of various elements and order of the steps of articles and methods described herein are not to be considered limiting. For instance, although the steps of the methods are described with reference to a sequential series of reference signs and progression of the blocks in the figures, the method can be implemented in any particular order as desired.

Figure 1:
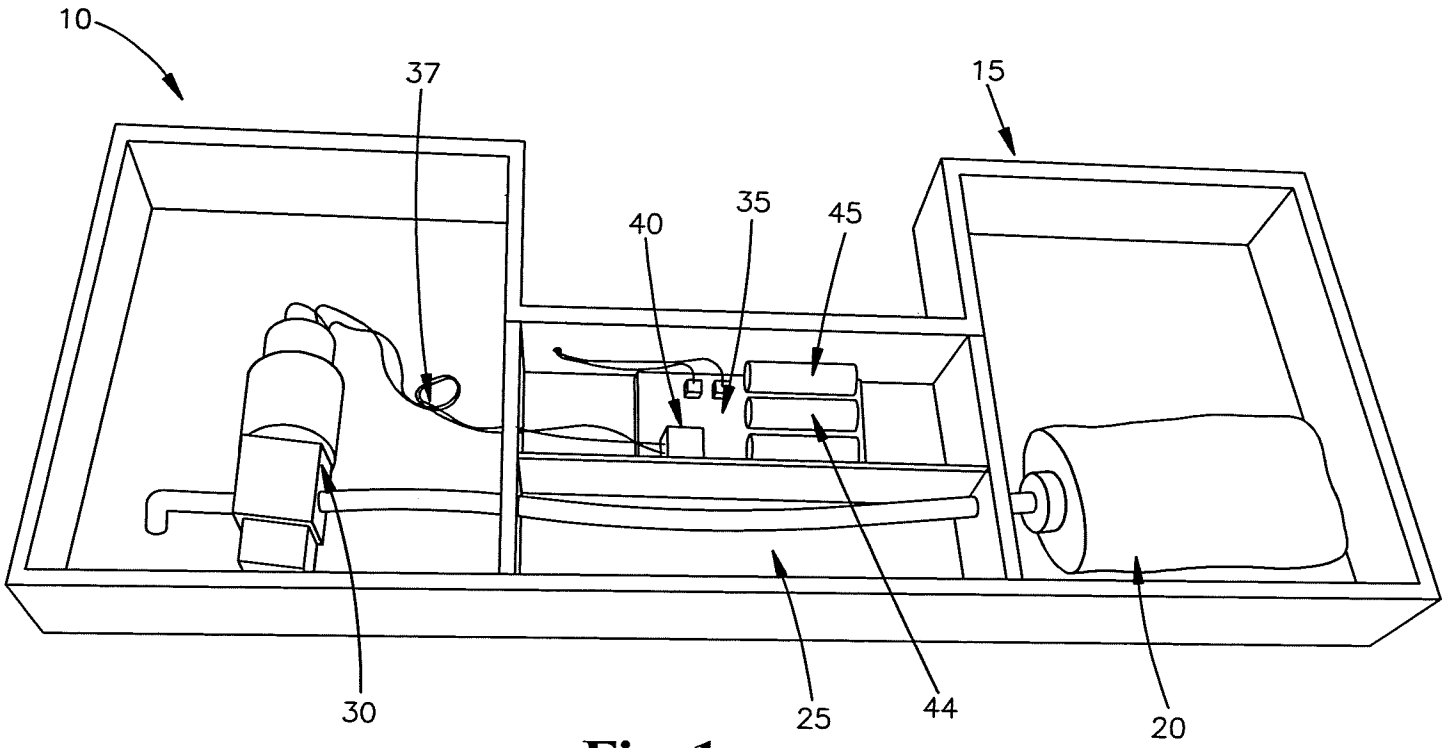
FIG. 1 is a top perspective view of an AMDS according to an embodiment of the present application.
Figure 2:
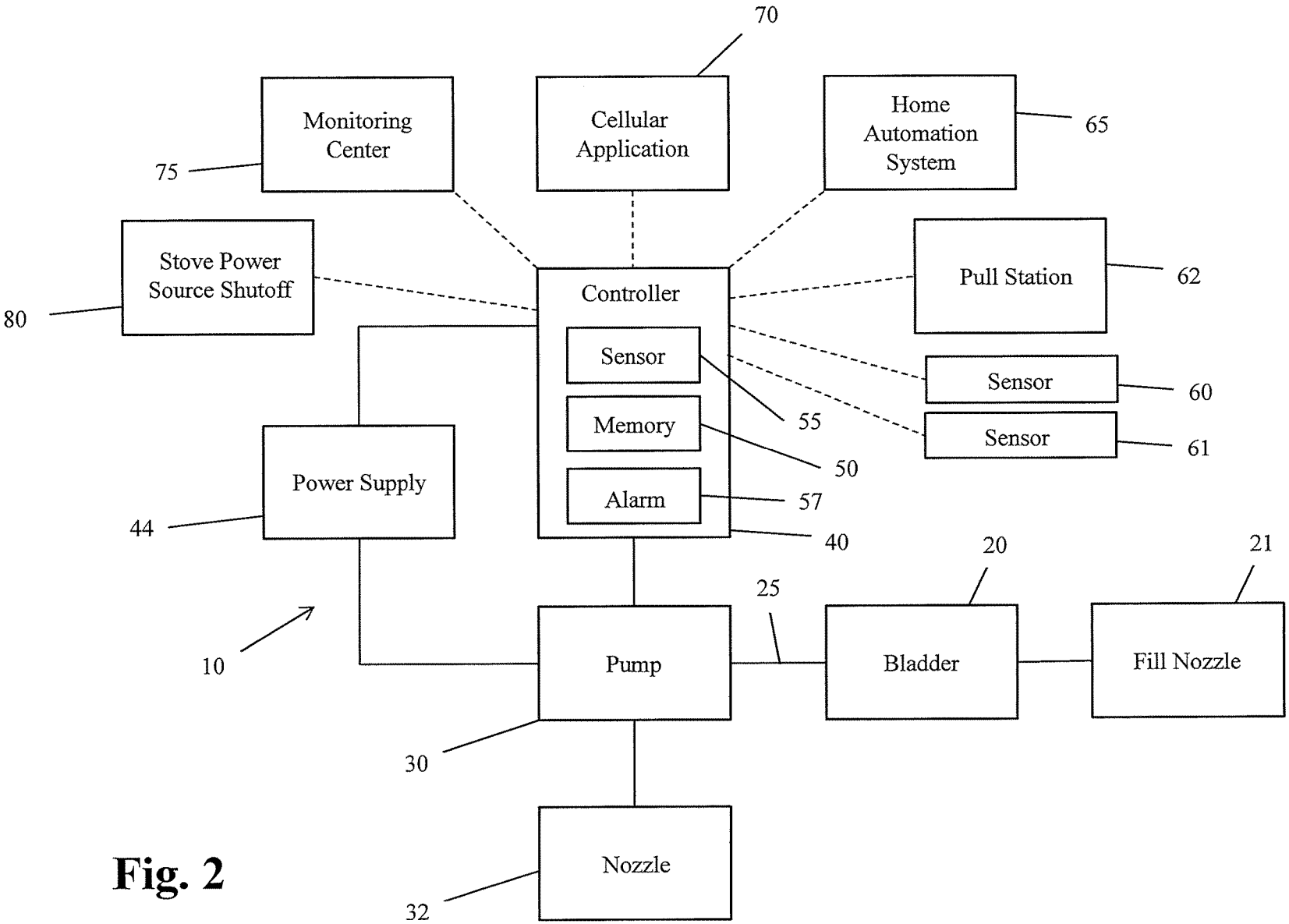
FIG. 2 is a schematic view of an AMDS system including the AMDS shown in FIG. 1.

Embodiments of the present application include an adjustable density misting delivery system (AMDS) 10 for detecting and neutralizing a fire. Referring to FIGS. 1 and 2, the AMDS 10 includes a housing 15 that is configured to contain various components of the AMDS 10. The housing 15 can be comprised of any variety of metals, plastics, or other materials as desired, and can be manufactured through molding, casting, thermoforming, etc. The housing 15 is substantially hollow, such that it is capable of containing a variety of the components of the AMDS 10. The housing 15 can also comprise a variety of shapes, such as rectangular, triangular, circular, etc. The shape of the housing 15 can be primarily determined by the intended mounting location of the AMDS 10, such that the housing can be configured to fit within a particular mounting location without being visually noticeable from an external position. For example, the housing 15 can be shaped to fit above a range hood of a conventional commercial or residential stovetop or within the range hood. Alternatively, the housing 15 can be mounted away from the stovetop, such as flush with a countertop adjacent to the stovetop or on a wall near the stovetop. The housing 15 can be mounted in any desired orientation, such as vertical or horizontal.

The AMDS 10 further includes features contained within and/or connected to the housing 15 that define a repository and flow path for fire suppressant material. The fire suppressant material can be a liquid, powder, or foam that is suitable for extinguishing a fire, particularly an oil or grease fire, where the use of water is not appropriate. This can be particularly useful in industrial, marine, municipal, oil, petrochemical, or transportation settings. In one example, the fire suppressant can be Pyrocool. Alternatively, the fire suppressant can be water. Further, the fire suppressant can be a class A foam, wetting agent, high expansion foam concentrate, or protein foam. However, the fire suppressant can be any type of fire suppressant as desired.

Continuing with FIGS. 1 and 2, the AMDS 10 includes a bladder 20 within the housing 15 that contains a fire suppressant material. The bladder 20 can comprise a pouch or bag made from a flexible moisture-impermeable material that is capable of housing the fire suppressant material indefinitely. For example, the bladder 20 can be formed from a polymer. The bladder 20 can be sized depending on the particular AMDS 10 it will be used in, as well as the intended installation setting of that AMDS 10. For example, the bladder 20 can contain between 16 and 48 ounces of a fire suppressant material. However, the bladder 20 can be sized to contain more or less fire suppressant material as desired. The bladder 20 can be non-pressurized, and can be either single-use or refillable. Further, the bladder 20 can comprise any plastic or other polymer as desired.

In embodiments where the bladder 20 is refillable, the AMDS 10 can include a fill nozzle 21 operatively connected to the bladder 20. The fill nozzle 21 can be integral with the housing 15, or the fill nozzle 21 can be exterior to the housing 15. In one embodiment, the fill nozzle 21 defines a portal (not shown) in fluid communication with the bladder 20, and a threaded cap (not shown) releasably securable to the portal. The fill nozzle 21 allows an owner or servicer of the AMDS 10 to refill the bladder 10 with fire suppressant material from an external supply (not shown) without dismantling the housing 15 and replacing the bladder 20. This allows a user of the AMDS 10 to ensure that the bladder 20 is sufficiently full at all times to extinguish a potential fire, and reduce waste by reuse of an existing bladder 20. In fire suppressant systems without refillable bladders, a suppressant storage device may need to be discarded before it is fully depleted because the remaining amount of fire suppressant is insufficient to extinguish a fire. This results in wasted fire suppressant, which increases costs associated with operating a fire suppressant system. Alternatively, the fill nozzle 21 allows an owner or servicer of the AMDS 10 to pump fire suppressant out of the bladder 20. This allows for easy replacement of fire suppressant when a different type of fire suppressant is desired, or the existing fire suppressant is deemed too dated.

The AMDS 10 further includes a pump 30 disposed within the housing 15, where the pump 30 is operatively connected to the bladder 20 through tubes 25. The pump 30 is configured to flow the fire suppressant material from the bladder 20 and through the tubes 25. The pump 30 can be any type of electric pump capable of actuating the flow of fire suppressant. For example, the pump 30 can be a gear pump, screw pump, progressing cavity pump, roots-type pump, plunger pump, triplex-style plunger pump, compressed air powered double-diaphragm pump, rope pump, impulse pump, hydraulic ram pump, radial flow pump, axial flow pump, mixed flow pump, educator jet pump, or gravity pump. The pump 30 can be capable of creating a pressure within the tubes 25 of between about 50 psi to about 100 psi (about 3.4 bar to about 6.9 bar). The pump 30 can also be capable of creating a flow rate of fire suppressant through the tubes 25 of about 4.0 cubic meters per minute. However, none of these ranges are meant to be construed as limiting, as the use of pumps capable of pressure and flow rates beyond the enumerated ranges is contemplated.

The tubes 25 are preferably comprised of a chemical and/or fire resistant material. Further, the tubes 25 can be flexible. Specifically, the tubes 25 can be comprised of metal or a flexible polymer. The tubes 25 can include one tube, or can include any number of tubes as desired. The fittings of the tubes 25 can be secured with shrink tubes (not shown), and portions of the tubes 25 can be connected via quick connect fittings (not shown). In addition to connecting the pump 30 to the bladder 20, the tubes 25 can connect the pump 30 and bladder 20 to a nozzle 32. The nozzle 32 can be integral with the housing 15. Alternatively, the nozzle 32 is releasably attached to the housing 15, such as through a threaded engagement. This allows the nozzle 32 to be easily replaced. The nozzle 32 can also include a barbed fitting that is configured to engage either the housing 15 or the tubes 25, such that the nozzle 32 is easily attachable to the AMDS 10. The nozzle 32 can define a variety of spray patterns, where each particular spray pattern is determined based upon the particular environment in which the AMDS 10 is installed, as well as the intended spray area and pattern of the fire suppressant. In one embodiment, the nozzle 32 defines a plurality of outlet holes (not shown), each of which can define a diameter that is between 0.05 mm to about 0.30 mm. Alternatively, the nozzle 32 can define a single outlet (not shown). The outlet of the nozzle 32 can be defined such that the fire suppressant material exits as particles and/or droplets with as small a diameter as possible, while still being large enough to be unaffected by heat rise and/or wind during a dispensing operation, which will be described further below. The nozzle 32 can further be configured such that the outlet can be manually adjustable by a user, such that the user can alter the outlet to suit a specific environment that the AMDS 10 is installed in.

The AMDS 10 further includes a power supply 44 that powers the pump 30. The power supply 44 can be disposed internally within the housing 15, or the power supply 44 can be spaced from the housing 15. As shown in FIG. 1, the power supply can include one or more batteries 45. However, the power supply 44 can also include a wired connection to an external power source, such as an electrical outlet. In one embodiment, the power supply 44 of the AMDS 10 can include both of one or more batteries 45 and a wired connection to an external power supply as a redundancy, such that the AMDS 10 continues to receive power during a power outage or in the event the charge of the batteries 45 becomes depleted. The power supply 44 can also power a controller 40 connected to a circuit board 35, where the controller 40 is electrically connected to and controls operation of the pump 30. The controller 40 can be connected to the pump 30 and the power supply 44 through wires 37.

The AMDS 10 also includes a sensor 60 in electronic communication with the controller 40. The sensor 60 notifies the controller 40 when a parameter that indicates the presence of a fire has been encountered, and can be in wired (such as through electrical wire or fiber optic cable) or wireless communication with the controller 40. For example, the sensor 60 can be a temperature sensor or a humidity sensor. However, the sensor 60 can be capable of measuring any different physical, chemical, or other environmental attributes that can be indicative of the presence of a fire, as well as differentiate between parameters indicative of a fire and those caused by a normal cooking process. The sensor 60 can be either active or passive. In one embodiment, the sensor 60 is an adjustable temperature probe or a fixed temperature sensor, and the sensor 60 notifies the controller 40 when the sensor 60 detects a temperature that surpasses a predetermined threshold. The predetermined temperature threshold can be between about 135 degrees Fahrenheit and 250 degrees Fahrenheit. In another embodiment, the sensor 60 notifies the controller 40 when the rate of increase of temperature surpasses a predetermined threshold. Alternatively, the threshold can be a humidity threshold. In a further embodiment, the sensor 60 can be a camera, such that the sensor 60 notifies the controller 40 when the sensor 60 detects a visual or infrared pattern indicative of a fire. Additionally, the sensor 60 can be capable of utilizing radar, infrared pulsing, sonar, laser, or other range detection methods to detect the amount and concentration of objects on a stovetop. The sensor 60 can be an audial sensor that detects sound patterns that are indicative of the presence of a fire, or third-part smoke or fire alarm that has activated in response to a fire. The controller 40 can continuously analyze the information received from the sensor 60, and determine when the parameter sensed by the sensor 60 indicates the presence of a fire. In another embodiment, the sensor 60 can comprise a spring-loaded, fusible link that melts in response to exposure to a predetermined temperature. As such, the sensor 60 can be single-use.

The AMDS 10 can include more than one sensor, such as two sensors—shown as sensors 60 and 61 in FIG. 2—for redundancy. When the AMDS 10 includes more than one sensor, the sensors 60 and 61 can each be of the same or different types, which can be selected from any of the sensor types enumerated above. The controller 40 can direct the pump 30 to activate when either of the sensors 60 or 61 detects a parameter indicative of the presence of a fire, or only when both of the sensors 60 or 61 detect a parameter indicative of the presence of a fire. The controller 40 can be configured to receive a user input that alters the threshold parameters in which the controller 40 will determine that a signal received from the sensor 60 or sensor 61 indicates the presence of a fire. This user input can be received from a home automation system 65, a cellular application 70, or a monitoring center 75, which will each be discussed further below, and can involve a keypad, touchscreen, voice commands, etc. For example, when the sensors 60 and/or 61 are temperature sensors, a user can provide an input to the controller 40 that lowers the temperature at which the controller 40 will determine that a fire is present to about 135 degrees Fahrenheit. Alternatively, a user can provide an input to the controller 40 that raises the temperature at which the controller 40 will determine that a fire is present to about 250 degrees Fahrenheit.

As indicated by the dashed lines in FIG. 2, the controller 40 can be in communication with aspects of the AMDS 10, in particular the sensor 60, wirelessly. For example, the controller 40 can receive from or transmit a signal to the sensor 60 via ZigBee, Z-wave, Bluetooh, Wi-Fi, or radio wave. In particular, the radio wave can be a 319.5 MHz radio wave. Additionally, 802.11 standards or 802.15 standards can be used. These methods of wireless connection are equally applicable to other components wirelessly connected to the controller 40, as described below. Such wireless connections allow the sensor 60 to be spaced from the housing 15, such that the sensor 60 can be positioned in a location that can provide the earliest indication that a fire has started. However, it is also contemplated that the sensor 60 can be connected to the controller 40 through wires. The controller 40 can also include an alarm 57 that is configured to transition from an inactive state to an active state when the controller determines that a fire has been sensed. For example, the alarm 57 can include a piezo device, a siren, and/or an LED light. In addition to indicating that a fire has been sensed, the alarm 57 can produce a certain notification that alerts the operator of a low charge of battery 45 or need for servicing of the AMDS 10, either upon sensing a particular issue or at a predetermined time interval.

The controller 40 can also include a memory unit 50 and a sensor 55. The memory unit 50 and sensor 55 provide the controller 40 with forensic and auditing functionalities. This functionality allows the AMDS 10 to record and store information in the memory unit 50 related to the operation of the AMDS 10, including static information related to component parts, operational statistics, and external factors (such as parameters that indicate the presence of a fire) that affect operation of the AMDS 10. The memory unit 50 can be volatile (such as some types of RAM), non-volatile (such as ROM, flash memory, etc.), or a combination thereof. Further, the memory unit 50 can include tape, flash memory, smart cards, CD-ROM, digital versatile disks (DVD) or other optical storage, magnetic cassettes, magnetic tape, magnetic disk storage or other magnetic storage devices, universal serial bus (USB) compatible memory, or any other medium which can be used to store information and which can be accessed by a user or operator of the AMDS 10. The memory unit 50 can be configured to store parameters detected by the sensor 50, as well as parameters detected by the sensor 60, over a period of time. Though the memory unit 50 is depicted as integral with the controller 40, the memory unit 50 can be spaced from the controller 40. For example, the memory unit 50 can be located at a monitoring center 75 or home automation system 65 (described further below). However, the memory unit 50 can be located at any remote database as desired.

In one embodiment, during the course of operating the AMDS 10, the sensor 55 can be configured to detect a parameter related to the certain aspects of the operation of the AMDS 10 and its component parts, such as time of activation of the pump 30, duration of operation of the pump 30, speed at which the pump 30 flows the fire suppressant, amount of fire suppressant flowed by the pump 30, reason for activation of the pump 30, and torque of the pump 30. As such, the sensor 55 can be a clock or timer, flow meter, volumetric flow meter, or torque meter. Though the sensor 55 is depicted as integral with the controller 40, the sensor 55 can be spaced from the controller 40. For example, the sensor 55 can be in communication with the pump 30, the tubes 25, or the bladder 20. Alternatively, the sensor 55 can be spaced some distance exterior to the housing 15. As such, the sensor 55 can be in either wired (such as through electrical wire or fiber optic cable) or wireless communication with the controller 40 when it is spaced from the housing 15. When the sensor 55 is in wireless communication with the controller 40, the wireless communication can be performed using via ZigBee, Z-wave, Bluetooth, Wi-Fi, or radio waves.

In addition to the information sensed by the sensor 55, the memory unit 50 can be preprogrammed with information related to the component parts of the AMDS 10. This information can include parameters of the nozzle 32, parameters of the motor 30, parameters of the bladder 20, serial numbers, part numbers, part tolerances, etc. This information can be programmed into the memory 50 upon manufacturing of the AMDS 10, by an installer of the AMDS 10, or by the end user of the AMDS 10. As a result, the information related to the component parts of the AMDS 10 stored by the memory unit 50 can be altered or overwritten when parts of the AMDS 10 are removed or replaced.

The memory unit 50 can further function to record information collected by the sensor 60 and/or sensor 61. This information can include temperature changes, rate of temperature change, vapor content, chemical composition, audio signal, or visual images. This information can be recorded on a continuous basis, and the memory unit 50 overwritten at predetermined intervals if no fire has been detected. Alternatively, the memory unit 50 can initiate recording data collected by the sensor 60 upon the controller's determination that a fire has been detected. This data, along any data stored that relates to components of the AMDS 10 or was collected by the sensor 55, can be useful for a variety of reasons. After the AMDS 10 has been activated and fire suppressant has been dispensed, retrospective analysis of the information stored in the memory unit 50 can help an owner of the building or business the AMDS 10 is installed in determine the cause of a fire. Alternatively, the information stored by the memory unit 50 can be later accessed and analyzed by an insurance company, emergency responder, or other regulatory agency to determine the cause of a fire and resulting liability. Additionally, the AMDS 10 manufacturer can collect information stored by the memory unit 50 to evaluate the performance of the AMDS 10 and further optimize the design and operation of the AMDS 10.

In addition to the components already listed, the controller 40 can also be in electronic communication with a variety of other components. In one embodiment, as shown in FIG. 2, the AMDS 10 can include a manual pull station 62 in communication with the controller 40 for manually transitioning the pump 30 between an activated state and a deactivated state. In one embodiment, the pull station 62 can take the form of a physical lever, switch, button, or similar device physically attached to the housing 15 that is in electrical communication with the controller 40. Upon actuation of the pull station 62, the pull station 62 can direct the controller 40 to either transition the pump 30 from a deactivated state to an activated state, or from an activated state to a deactivated state. Manual actuation of the pump 30 allows a user to deactivate the pump 30 if the user of the AMDS 10 sees that a fire has been extinguished, or manually activate the pump 30 if the user detects a fire that has not been detected by the sensor 60. The addition of a pull station 62 also enables the AMDS 10 to comply with the UL 300 Standard, which relates to fire testing of fire extinguishing systems for the protection of commercial cooking equipment. Compliance with UL 300 standards can be mandatory for commercial kitchens in many localities.

However, in another embodiment, the pull station 62 can be spaced from the housing 15. In this embodiment, the pull station 62 can still comprise a physical lever, switch, button or similar device, but can be isolated from the housing 15. For example, the pull station 62 can be disposed on a wall near a stovetop, in a cupboard, adjacent to a light switch, under a countertop, or any other location as desired by an operator of the AMDS 10. Additionally, the pull station 62 can be electronically connected to the controller 40 either through a wired or wireless connection. Like the sensor 60 indicated above, the wireless communication between the controller 40 and the pull station 62 can be performed via ZigBee, Z-wave, Bluetooth, Wi-Fi, or radio waves. Even though the pull station 62 is depicted as separate from other components of the AMDS 10, the pull station 62 can be designed as an integral feature of another aspect of the AMDS 10. For example, the pull station 62 can be included in a home automation system 65, cellular application 70, or monitoring center 75 (each of which will be described further below). As such, the pull station 62 can take the form of a digital feature of any of the aforementioned components rather than a physical switch or button.

Continuing with FIG. 2, the AMDS 10 can further be in communication with a home automation system 65. The home automation system 65 can be any conventional type of home automation system, and can be configured to control and monitor various other residential or business features in addition to the AMDS 10, such as lights, entry alarms, thermostats, locks, etc. The AMDS 10 can be integrated with the home automation system 65 either through wires or wirelessly, which allows a user to control or monitor the AMDS 10 through a hub or other user input of the home automation system 65. When wirelessly connected, the wireless communication between the home automation system 65 and the AMDS 10, particularly the controller 40, can be performed via ZigBee, Z-wave, Bluetooth, Wi-Fi, or radio waves. For example, a user can use the home automation system 65 to monitor such information related to the AMDS 10 as the status of the power supply 44, amount of fire suppressant in the bladder 20, parameters sensed by the sensor 60 and/or 61, and mode (active or inactive) of the pump 30. Additionally, a user can update settings of the AMDS 10 through a user input of the home automation system 65, such as the predetermined threshold for a parameter that indicates the presence of a fire or the mode of operation of the pump 30.

Like the home automation system 65, the AMDS 10 can also be in communication with a cellular application 70. The cellular application 70 can be specifically suited for cellular devices, or can be configured to operate on any type of electronic device, such as a tablet, laptop, PC, etc. The cellular application 70 can also be specifically designed to monitor the AMDS 10, or can be a third party application configured to integrate with the AMDS 10. Connection to the AMDS 10 with a cellular application 70 also allows multiple users to monitor and/or control the AMDS 10 at once. Connection to a cellular application 70 can be done through any form of wireless communication, such as via ZigBee, Z-wave, Bluetooth, Wi-Fi, or radio waves. Like the home automation system 65, a user can use the cellular application 70 to monitor information related to the AMDs 10 and/or update settings of the AMDs 10 through the user interface (not shown) of the cellular application 70.

Further, the AMDS 10 can be in communication with a monitoring center 75. The monitoring center 75 can be a third party service that monitors a plurality of AMDS 10 across many locations, or can be the dispatch center for first responders. Like the home automation system 65 and the cellular application 70, the connection between the AMDS 10 and the monitoring center 75 can be wireless, and can be performed using via ZigBee, Z-wave, Bluetooth, Wi-Fi, or radio waves. Alternatively, the connection can be wired through conventional electrical wires or fiber optic cable. When the monitoring center 75 receives a signal from the controller 40 that the sensor 60 has detected a parameter that the controller 40 determines indicates the presence of a fire, the monitoring center 75 can contact the owner of the AMDS 10, as well as notify the nearest fire department in order to dispatch first responders to the location of the AMDS 10. Optionally, if the owner notifies the monitoring center 75 that the notification was a false alarm, the monitoring center 75 may not contact the fire department.

Continuing with FIG. 2, the AMDS 10 can also include a stove power source shutoff 80 that is in electrical or fluid communication with the power source of a residential or commercial stove. The stove power source shutoff 80 can comprise a valve, switch, or other means for cutting off power to a stove when the controller 40 determines that the sensor 60 has detected a parameter indicative of a fire. As such, the stove power source shutoff 80 can be utilized with both electric and gas-powered ranges. In addition to dispensing fire suppressant from the nozzle 32, this functionality allows the AMDS 10 to ensure that the initial cause of the fire, whether it is burnt food or grease, is not provided more fuel. In one embodiment, the controller 40 automatically activates the stove power source shutoff 80 when the controller 40 determines that the sensor 60 has detected a parameter indicative of a fire. Additionally, the AMDS 10 can allow a remote user to manually activate the stove power source shutoff 80 remotely, which can be performed using the pull station 62, home automation system 65, cellular application 70, monitoring center 75, or through a user input (not shown) on the housing 15 of the AMDS 10 itself.

Figure 3:
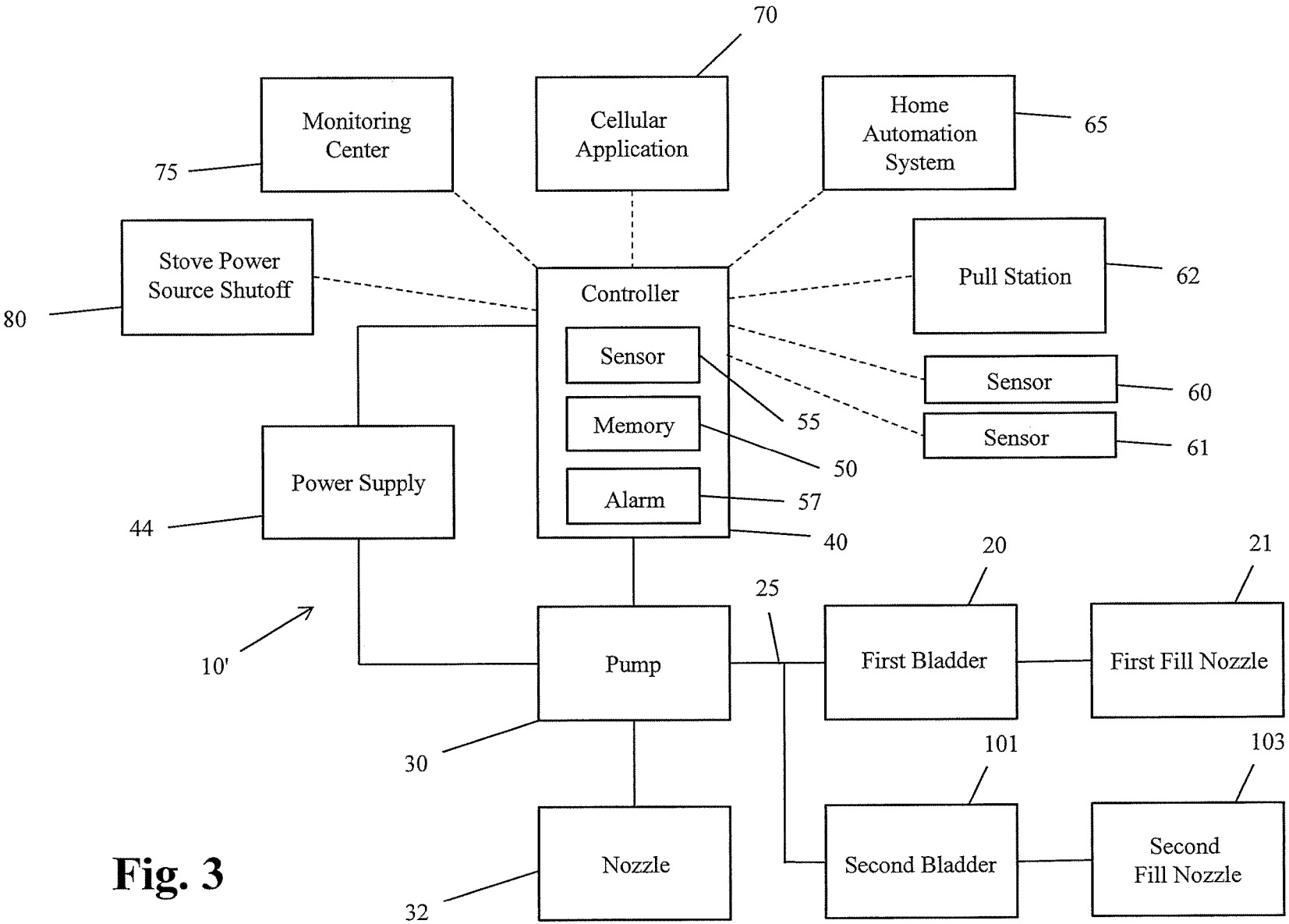
FIG. 3 is a schematic view of an AMDS system according to another embodiment of the present application.

Referring to FIG. 3, an AMDS 10' according to an alternative embodiment will be described. The AMDS 10' shares many similar features with AMDS 10, and as such identical reference numbers will be used. However, in AMDS 10', the bladder 20 is a first bladder and the nozzle 21 is a first fill nozzle. As such, the AMDS 10' includes a second bladder 101 and a second fill nozzle 103 in fluid communication with the pump 30 and nozzle 32 through tubes 25. The addition of a second bladder 101 and second fill nozzle 103 serves several purposes. In one aspect, certain environments or potential fire sources can require a mix of different fire suppressants to adequately address. However, certain fire suppressants may not be able to be mixed until the moment of application to the fire source. As such, the first bladder 20 can contain a first fire suppressant material, while the second bladder 101 contains a second fire suppressant material. The addition of a second bladder 101 and second fill nozzle 103 addresses this functionality by providing a user of the AMDS 10' a second repository for storing fire suppressant that is separate from the first bladder 20. Alternatively, the second bladder 101 and second fill nozzle 103 can serve as a redundancy for the first bladder 20 and first fill nozzle 32. In the event that the bladder 20 becomes obstructed for some reason or becomes fully depleted, the pump 30 will still be able to draw fire suppressant material from the second bladder 101.

Figure 4:
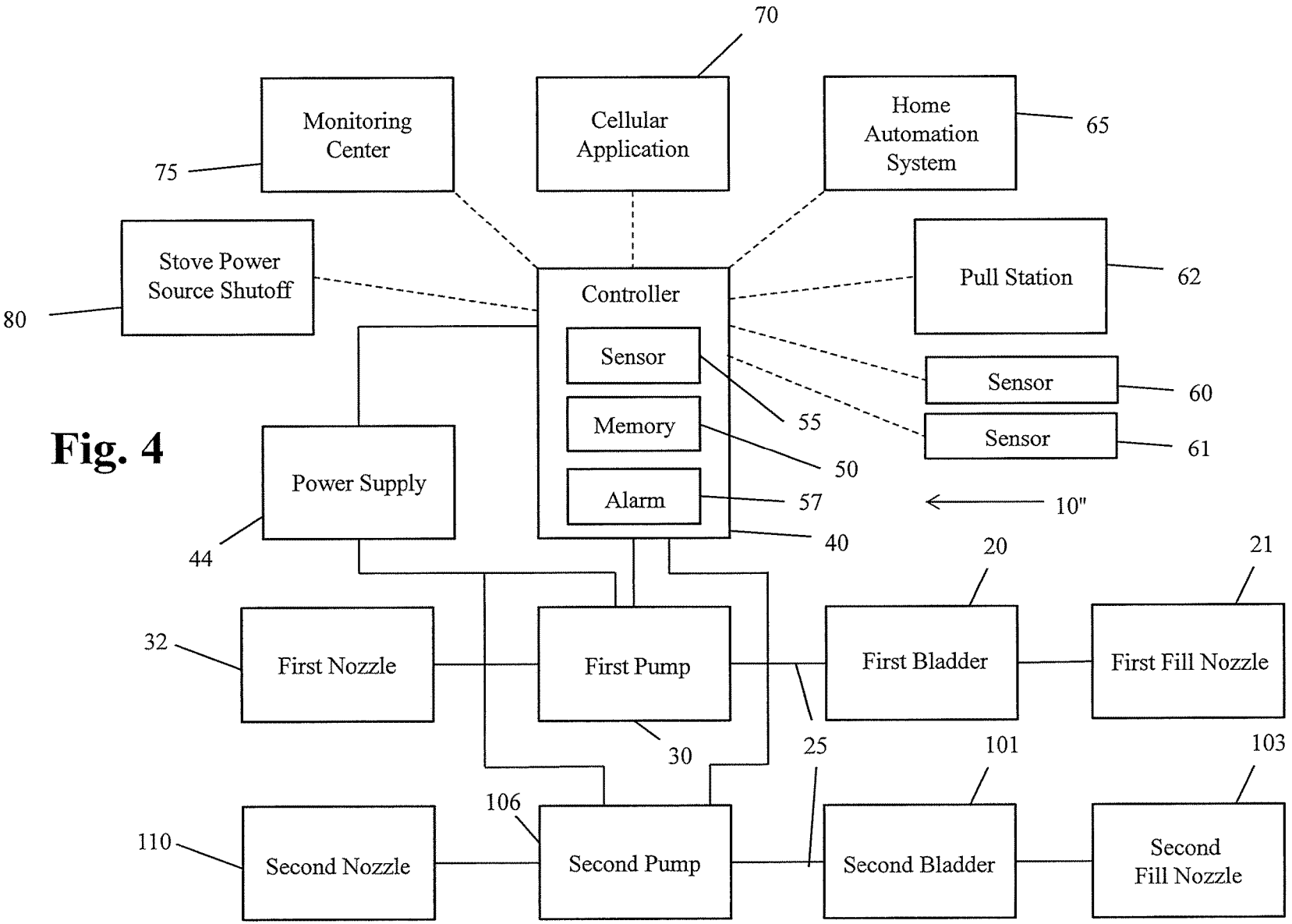
FIG. 4 is a schematic view of an AMDS system according to a further embodiment of the present application.

Referring to FIG. 4, an AMDS 10" according to another alternative embodiment will be described. The AMDS 10" shares many similar features with the AMDS 10 and AMDS 10', and as such identical reference numbers will be used. Like the AMDS 10', the AMDS 10" includes first and second fill nozzles 21 and 103, as well as first and second bladders 20 and 101. However, in the AMDS 10", the pump 30 is a first pump and the nozzle 32 is a first nozzle 32, and the AMDS 10" further includes a second pump 106 and a second nozzle 110. As such, the AMDS 10" can include two completely separate flow paths, with one flow path comprising the first fill nozzle 21, first bladder 20, first pump 30, and first nozzle 32, while the second flow path includes the second fill nozzle 103, second bladder 101, second pump 106, and the second nozzle 110. Like the first pump 30, the second pump 106 can receive power from the power supply 44 and be controlled by the controller 40. As with the second fill nozzle 103 and the second bladder 101, the inclusion of the second pump 106 and the second nozzle 110 provides redundancy to the AMDS 10", such that if something happens to the first pump 30 and first nozzle 32, such as the first pump 30 becoming nonoperational or the first nozzle 32 becoming clogged, the AMDS 10" has a completely separate flow path that can serve as a backup. Further, in some embodiments, the inclusion of the second pump 106 and the second nozzle 110 provides the opportunity to provide a second source of fire suppressant material that is different than or duplicative of the first fire suppressant material.

Figure 5:
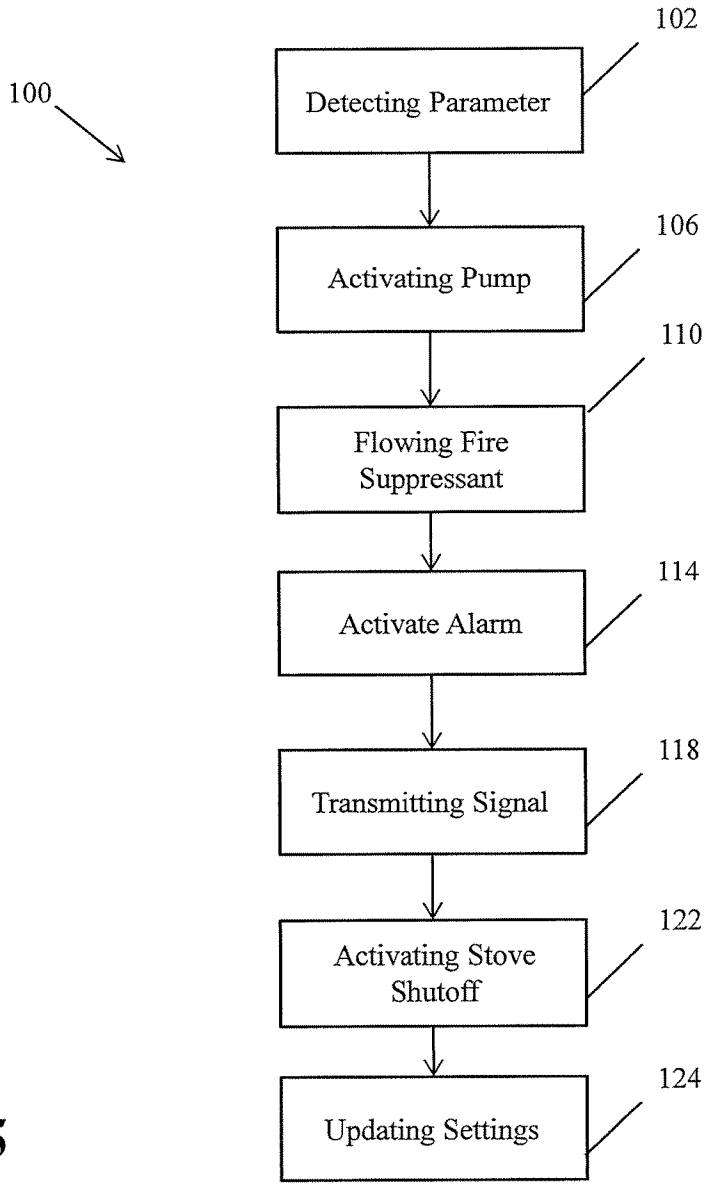
FIG. 5 is a process flow diagram of a method according to an embodiment of the present application.

Referring to FIG. 5, operation of the AMDS 10 according to method 100 will be described. Though described specifically in relation to the AMDS 10, method 100 may similarly be employed with AMDS 10' and AMDS 10". At the beginning of method 100, the AMDS 10, and particularly the pump 30, will be in an initial deactivated state. In this deactivated state, the pump 30 is not operating and thus no fire suppressant is flowing through the tubes 25 and out the nozzle 32. However, as shown in step 102 of method 100, at a certain time the sensor 60 (an/or sensor 61) can detect a parameter that the controller 40, based upon predetermined thresholds, determines indicates the presence of a fire. At this time, in step 106, the controller 106 activates the pump 30 from the initial deactivated state to an activated state when the sensor 60 (and/or sensor 61) detects the parameter. When the pump is in the activated state, step 110 is performed, which involves the pump 30 flowing fire suppressant from the bladder 20, through the tubes 25, and out of the nozzle 32.

The flowing step 110 can take several different embodiments, primarily based upon the mode that the pump 30 is operating in. In one embodiment, step 110 includes continuously flowing fire suppressant through the tubes 25 and out the nozzle 32 for a period of time. Though this can be the quickest method of putting out a fire, it can also exhaust the supply of fire suppressant the quickest. As such, other embodiments of step 110 are contemplated. For example, in another embodiment, step 110 involves intermittently flowing fire suppressant out of the bladder 20, such that the fire suppressant flows for a period of time, stops flowing out of the nozzle 32 for a second period of time that is after the first period of time, and resumes flowing the first suppressant from the bladder 20, through the tubes 25, and out the nozzle 32 for a third period of time that is after the second period of time. Subsequent periods of stopping and starting flow are also possible. This embodiment can function to help conserve fire suppressant by increasing the time period before the bladder 20 becomes depleted. For example, the first, second, and third period of times can be 30 seconds. However, the first, second, and third periods of time can be other increments of time as desired. Step 110 can also include a special dispensing operation, in which a marker or special fluid flows through tubes 25 and out of nozzle 32 in addition to or in place of the fire suppressant material for forensic purposes. Further, step 110 can comprise a preventative dispensing operation, in which the fire suppressant does not flow out of the nozzle 32 directly onto a fire, but rather flows out of the nozzle 32 to a periphery of the fire, such that the AMDS 10 prevents the fire from spreading.

The method 100 can further include step 114, which involves activating an alarm 57 upon the controller 40 determining that the sensor 60 has detected a parameter indicative of the presence of a fire. As noted above, the alarm 57 can include a piezo device, a siren, and/or an LED light. Additionally, the method 100 can include step 114, which involves transmitting a signal from the controller 40 to a monitoring center that indicates that the sensor 60 detected the parameter than the controller 40 determines indicates a fire's presence. While the term "monitoring center" is used, step 114 can include transmitting the signal that indicates that the sensor 60 detected the parameter than the controller 40 determines indicates a fire's presence to the home automation system 65, the cellular application 70, and/or the monitoring center 75. In other embodiments, the signal can indicate a variety of other statuses related to the AMDS 10, including a low charge of the battery 45, low level of fire suppressant material, need for servicing, etc. Method 100 can further include step 122, which includes activating the stove power source shutoff 80 in response to the sensor 60 detecting the parameter than the controller 40 determines indicates the presence of a fire. As noted above, the stove power source shutoff 80 can comprise a valve, switch, or other means for cutting off power to a stove that is usable with both electric and gas-powered ranges. This ensures that the initial cause of the fire, whether it is burnt food or grease, is not provided more fuel. Additionally, method 100 can include step 144, which involves transmitting a signal from a user input to the controller 40 that updates a setting of the AMDS 10. This user input can be located at the monitoring center 75, the cellular application 70, or the home automation system 65. In one embodiment, the setting that can be updated is the threshold for the parameter detected by the sensor 60 (for example, the temperature threshold), where the threshold is the limit beyond which the controller 40 determines that a fire is present. Though steps 110-124 are shown sequentially in a particular order in FIG. 5, each of steps 110-124 can be performed interchangeably in other orders as desired.

The present disclosure is described herein using a limited number of embodiments. These specific embodiments are not intended to limit the scope of the disclosure as otherwise described and claimed herein. Modification and variations from the described embodiments exist. More specifically, the examples included are given as a specific illustration of embodiments of the claimed disclosure. It should be understood that the invention is not limited to the specific details set forth in the examples, and that various changes, substitutions, and alterations can be made without departing from the spirit and scope of the invention as defined by the appended claims.

What is claimed:

1. An advanced adjustable density misting delivery system (AMDS) for detecting and neutralizing a fire, the AMDS comprising:

a bladder containing a fire suppressant material;

a pump operatively connected to the bladder via a tube;

a nozzle operatively connected to the pump and the bladder via the tube;

a controller electrically connected to the pump;

a sensor in communication with the controller, the sensor being configured to detect a parameter that indicates the presence of the fire; and a power supply configured to provide power to the controller and the pump, wherein the controller is configured to transition the pump from a deactivated state to an activated state when the sensor detects the parameter, such that in the deactivated state the pump does not operate, and in the activated state the pump pumps the fire suppressant from the bladder, through the tube at a pressure of between about 50 psi and about 100 psi, and out the nozzle.

2. The AMDS of claim 1, wherein the controller includes an alarm that is configured to transition from an inactive state to an active state when the sensor detects the parameter.

3. The AMDS of claim 2, wherein the alarm is a piezo device, an LED light, or a siren.

4. The AMDS of claim 1, wherein the power supply comprises one or more batteries, a wired connection to an external power supply, or the one or more batteries and the wired connection to the external power supply.

5. The AMDS of claim 1, further comprising a fill nozzle operatively connected to the bladder, wherein the fire suppressant material can be disposed from an external supply through the fill nozzle to refill the bladder.

6. The AMDS of claim 1, wherein the bladder is a first bladder and the fire suppressant material is a first fire suppressant material, and the AMDS further comprises a second bladder that contains a second fire suppressant material.

7. The AMDS of claim 1, wherein the bladder is non-pressurized.

8. The AMDS of claim 1, wherein the parameter is a humidity threshold, a temperature threshold, a sound pattern, a temperature increase rate threshold, a visual pattern, or an infrared pattern.

9. The AMDS of claim 1, wherein the sensor is in communication with the controller through a wireless connection.

10. The AMDS of claim 9, wherein the sensor is configured to transmit a signal to the controller that indicates detection of the parameter through the wireless connection via ZigBee, Z-wave, or radio wave.

11. The AMDS of claim 1, wherein the sensor is a first sensor and the parameter is a first parameter, and the controller includes a memory unit and a second sensor configured to detect a second parameter related to the operation of the AMDS.

12. The AMDS of claim 1, wherein the sensor is a first sensor, the AMDS further comprising a second sensor configured to detect the parameter that indicates the presence of the fire, wherein the controller is configured to transition the pump from a deactivated state to an activated state when both the first and second sensors detect the parameter.

13. An advanced adjustable density misting delivery system (AMDS) for detecting and neutralizing a fire, the AMDS comprising:

a bladder containing a fire suppressant material;

a pump operatively connected to the bladder via a tube;

a nozzle operatively connected to the pump and the bladder via the tube, wherein the pump is configured to pump the fire suppressant from the bladder, through the tube at a pressure of between about 50 psi and about 100 psi, and out the nozzle;

a controller electrically connected to the pump, wherein the controller includes a first sensor configured to detect a first parameter related to the operation of the AMDS;

a second sensor in communication with the controller, the second sensor being configured to detect a second parameter that indicates the presence of the fire; and a power supply configured to provide power to the controller and the pump.

14. The AMDS of claim 13, wherein the first parameter includes a duration of operation of the pump, a speed at which the pump flows the fire suppressant, a time of activation of the pump, or a reason for activating the pump.

15. The AMDS of claim 13, further comprising a stove power source shutoff configured to cut off power to a stove, wherein the controller is configured to direct the stove power source shutoff to cut power to the stove when the second sensor detects the second parameter.

16. The AMDS of claim 13, wherein the controller further includes a memory unit configured to store the first parameter detected by the first sensor and the second parameter detected by the second sensor during the course of operating the AMDS.

17. The AMDS of claim 13, wherein the controller is configured to transmit a signal to a home automation system, wherein the signal indicates to the home automation system that the second sensor has detected the second parameter.

18. The AMDS of claim 13, wherein the controller is configured to transition the pump from a deactivated state to an activated state when the second sensor detects the second parameter.

* * * * *